US005611633A

United States Patent [19]

Whaley

[11] Patent Number: 5,611,633

[45] Date of Patent: Mar. 18, 1997

[54] RING BINDER ASSEMBLY

[76] Inventor: Paul Whaley, 208 Aldergate, Bonne Terre, Mo. 63126

[21] Appl. No.: 671,063

[22] Filed: Jun. 27, 1996

[51] Int. Cl.[6] ..... B42F 3/00

[52] U.S. Cl. ..... 402/60; 402/73

[58] Field of Search ..... 402/19, 24, 26, 402/46, 55, 56, 60, 61, 67, 73

[56] References Cited

U.S. PATENT DOCUMENTS

| | | | |
|---|---|---|---|
| 828,974 | 8/1906 | Schmidmer | 402/60 X |
| 841,525 | 1/1907 | Huffman | 402/60 X |
| 1,414,758 | 5/1922 | Stavenhagen | 402/6 |
| 2,164,514 | 7/1939 | Goldstein | 402/60 X |
| 4,172,675 | 10/1979 | Lacur | 402/55 X |
| 5,265,967 | 11/1993 | Han . | |
| 5,476,335 | 12/1995 | Whaley . | |

*Primary Examiner*—Willmon Fridie, Jr.
*Attorney, Agent, or Firm*—Polster, Leider, Woodruff & Lucchesi

[57] ABSTRACT

A binder (10) is for use in storing sheets (S) of paper having punched holes (H) in them. First and second end leafs (12, 14) respectively form outer covers of the binder. A center section (18) is intermediate the respective end leafs. One side of each of the end leafs is flexibly attached to opposite sides of the center plate for sheets of paper stored in the binder to be enclosed between the end leafs. A plurality of binder rings (22–30) hold the sheets of paper, and the rings are movable from a closed position to an open position so sheets of can be fitted into or removed from the binder. A backplate channel (48) is affixed to a centerplate (42), and one end of the rings fit through openings in this channel. The other end of the rings are secured to a ring channel (46) which, in turn, is secured to the center plate by screws (70). When the screws are removed, the ring channel can be lifted away from the center plate, opening the rings.

20 Claims, 3 Drawing Sheets

RING BINDER ASSEMBLY

BACKGROUND OF THE INVENTION

This invention relates to ringbinders for holding sheets of paper and other similar material in which holes are punched, and more particularly to a ring binder assembly for use in such ringbinders.

In co-pending U.S. patent application Ser. No. 414,207/08 filed March 31, 1995, there is described an arch ring binder assembly used to hold and store punched sheets of paper, and other suitably punched materials, in a ringbinder. The ringbinders with which the assembly described therein is used are larger size ringbinders such as may be found in a variety of commercial applications. That is, ringbinders for storing pages of catalog information sheets, "spec" sheets, etc. And, because there is a constant flow of information, it is important that the material be safely stored so that the latest information is available to a user. It is not uncommon that information sheets which are replaced also be stored, and that this information, although it can become voluminous, be safely stored for ready reference. As noted, previous ringbinders were not very efficient for the storage of the substantial quantity of paper which had to be dealt with. Problems such as "sponginess" (caused by excess paper in a binder tending to pull binder segments apart) resulted in mishaps which are readily avoided by use of a ringbinder such as described in the aforementioned co-pending patent application and the current invention.

In addition to resolving the above described problems, it sometimes occurs that material installed in a ringbinder is intended to be left there permanently. Or, it also sometimes occurs that material stored in an expensive ringbinder (leather covered, for example) needs to be added to with the new material now exceeding the capacity of the ringbinder. Given the expense of the ringbinder, it would be wasteful to discard it when it should be possible to readily increase its capacity. This can be done relatively inexpensively, while the same time insuring that material permanently stored in the bingbinder is safely stored.

SUMMARY OF THE INVENTION

Among the several objects of the present invention may be noted the provision of a ringbinder for use in storing substantial quantities of paper or similar punched materials;

the provision of such a ringbinder which positively and securely retains all of the material stored in the binder, and does not inadvertently open when a greater volume of material is stored in the binder;

the provision of a ring binder assembly for the binder to safely and securely store the material in the binder;

the provision of such a ring binder assembly usable in a wide variety of binders applications including permanent storage of paper and other hole punched material, and to provide a solid locking arrangement for the stored material;

the provision of such a ring binder assembly to provide full page readability of papers stored in a binder, and to allow individual pages to be readily copied without having to first be removed them from the binder;

the provision of such a ring binder assembly having a standard frame, but a locking mechanism which is easily replaceable if the storage capacity of the ringbinder needs to be increased by replacing a locking mechanism having a binder ring of one length with a mechanism having a longer binder ring;

the provision of such a locking mechanism which is lockable using any of a variety of devises including, but not limited to slotted head and phillips head screws, tork screws, etc.;

the provision of such ring binder assembly in which the rings are smooth surfaced so as to not cause tears in the paper about the holes punched therein when papers are moved about;

the provision of such a ring binder assembly having tings available in several standard lengths to adjust the storage capacity of a binder; and, the provision of such a ring binder assembly which is low cost, and easy to install during fabrication of a binder.

In accordance with the invention, generally stated, a ringbinder is for storing sheets of paper having punched holes in them. First and second end leafs respectively form outer covers of the binder. A center plate is located intermediate the leafs with one side of each of the end leaf flexibly attached to the center plate for sheets of paper stored in the binder to be enclosed between the end leafs. Binder rings carded on the center plate hold the sheets in storage. One end of the rings are attached to a ring channel which is secured to a backing plate of a ring binder assembly by screws or the like. The other end of the tings fit through spaced openings in a backplate channel which is attached to the backing plate. The rings are movable by removing the screws and lifting the ring channel. This movement exposes the other end of the rings by removing them from the openings in the backplate channel. Sheets of paper, or other punched material are inserted into the binder by inserting the holes punched in the sheets over the exposed end of the rings. The binder rings are available in different lengths and the capacity of the binder is readily increased by exchanging one binder ring/ring channel sub-assembly of the ring binder assembly for another with longer rings. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
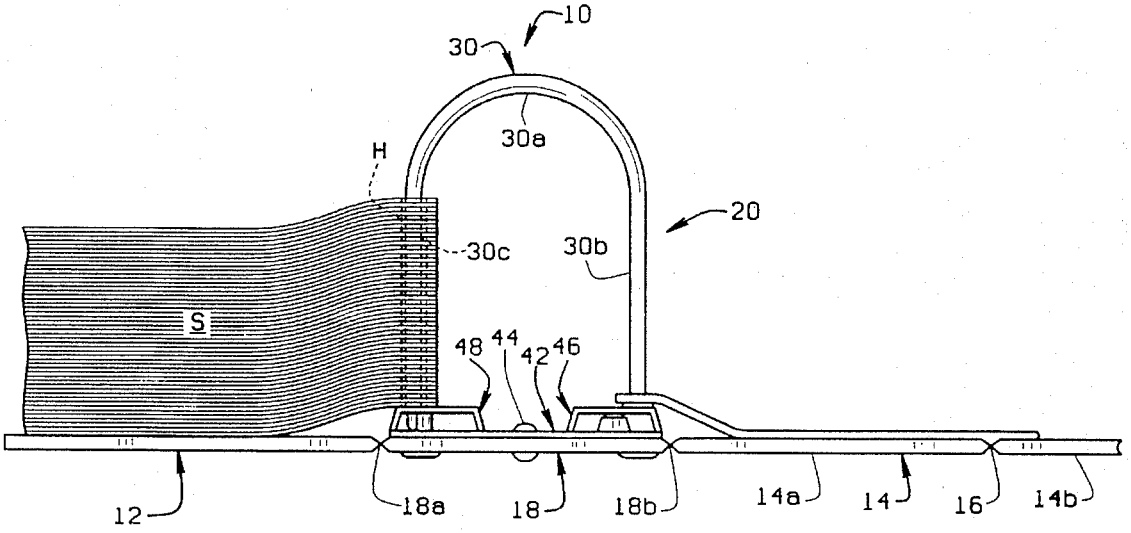
FIG. 1 is an end elevational view of a ringbinder employing the ring binder assembly of the present invention in a binder open position.

Referring to the drawings, a ringbinder indicated generally 10 is for storing sheets S of paper having punched holes H in them. Binder 10 can store substantial quantities of paper or other hole-punched material than is usually stored in conventional binders. A problem with conventional binders is that when a substantial quantities of paper are stored in them, the weight and volume of paper tends to pull sections of the binder apart. With the present invention, these amounts of paper are positively and safely secured within the binder, and the binder can be opened only by an action of a person using it.

Figure 2:
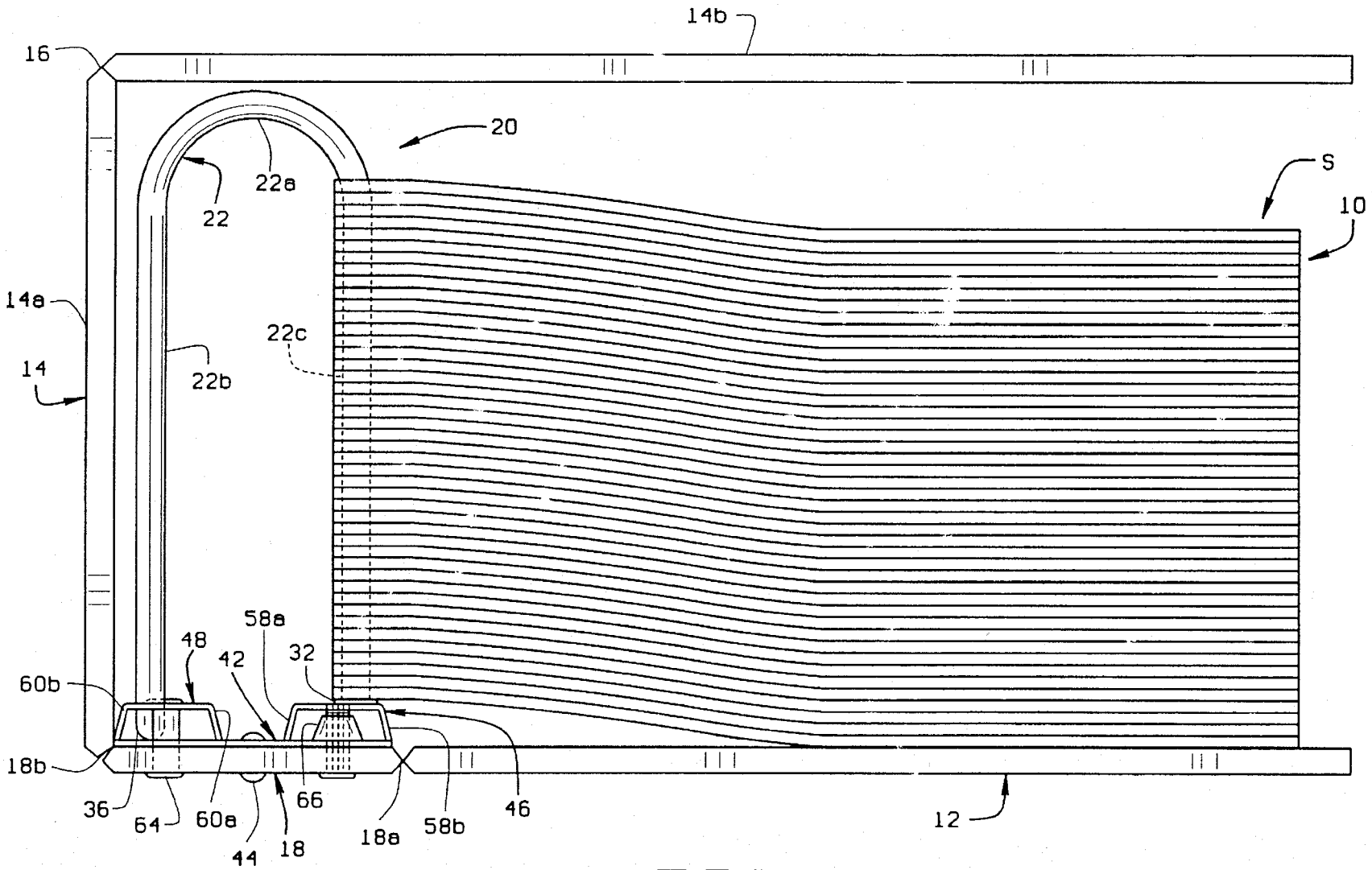
FIG. 2 is an elevational view of the ringbinder in its closed position.

Binder 10 includes first and second end leafs 12 and 14 which respectively form the outer covers of the binder. The leafs are of a generally rectangular shape and are made of any suitable material. In more expensive binders 10, the covers may be of leather. The length and width of the leafs are a function of the size of the sheets S of paper stored in the binder. As shown in FIG. 2, leaf 14 has a extending longitudinally fold 16 which divides the leaf into an inner section 14*a* and an outer section 14*b*. The fold allows the outer section of leaf 14 to be folded over a stack of paper. A center section or plate is 18 forms the spine of the binder. One side of each of the end leafs is flexibly attached to a respective side of center plate 18 in any suitable manner. A fold 18*a* is thus formed between the end leaf 12 and the center plate, and a fold 18*b* between end leaf 16 and the center plate. The width of plate 18 depends upon the amount of paper stored in the binder, and the height of the plate corresponds to that of end leafs.

Figure 3:
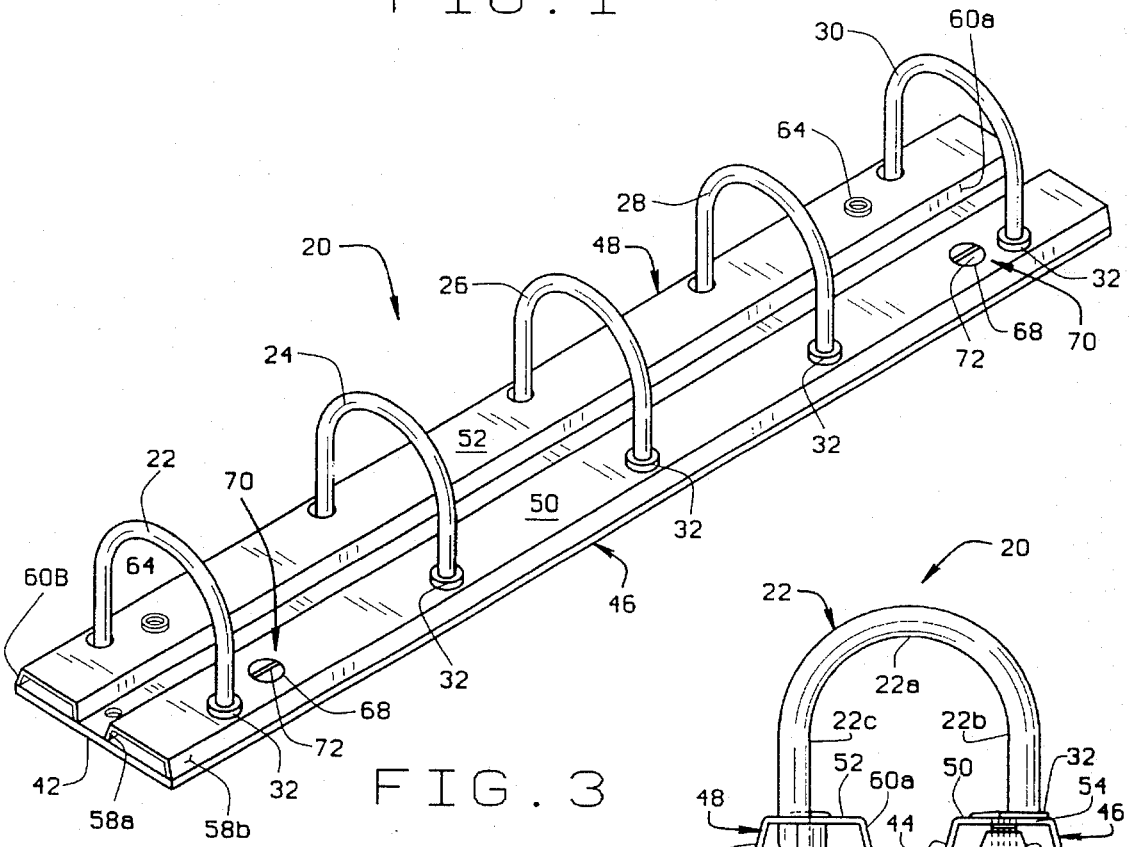
FIG. 3 is a perspective view of the ring binder assembly.
Figure 4:
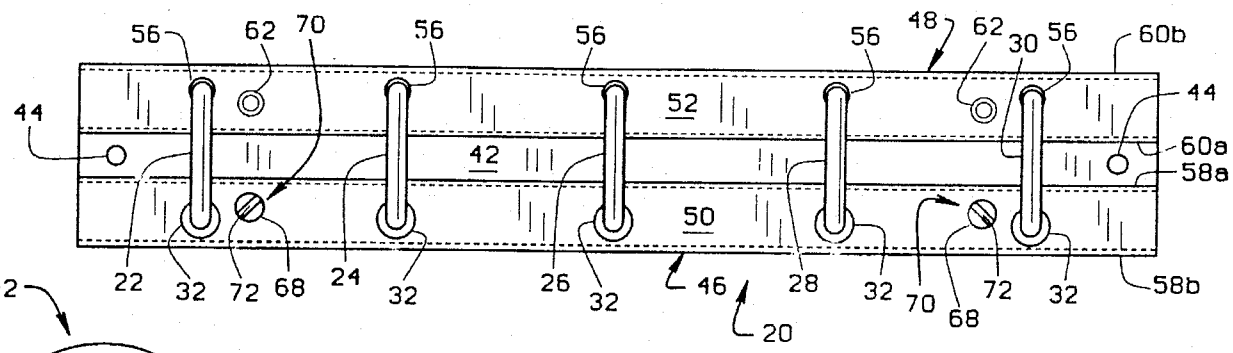
FIG. 4 is a top plan view of the assembly.
Figures 6A, 6B, 6C, 6D:
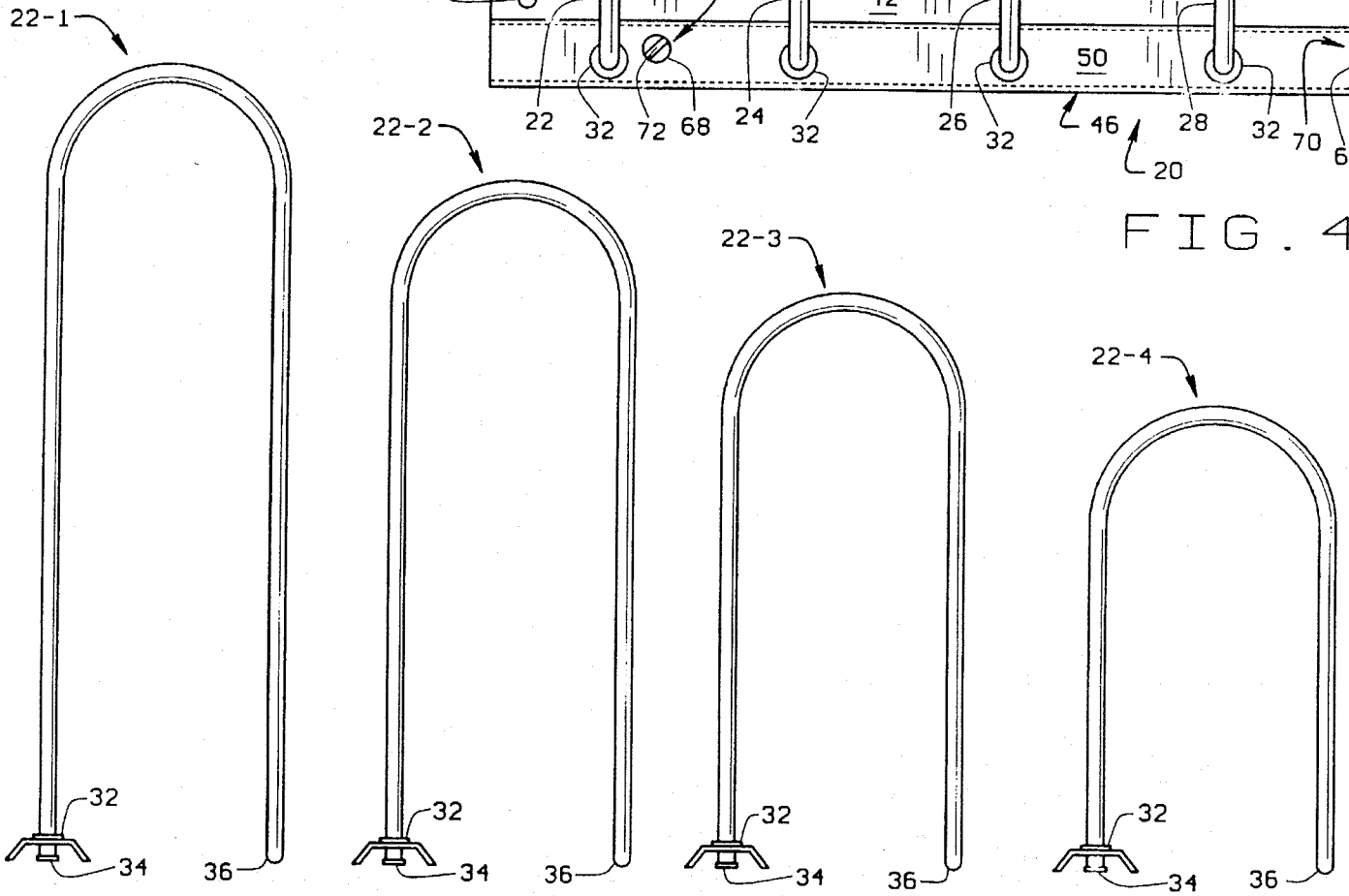
FIGS. 6A–6D are elevational views of a plurality of arched rings used with the assembly, the rings having different lengths for a binder to have different storage capabilities.

A ring binder assembly of the present invention is indicated generally 20. The assembly includes a plurality of spaced binder rings which hold sheets S of paper stored in the binder. The sheets S have holes H punched in them at locations corresponding to the position of the binder rings so the sheets can be inserted onto the rings. In FIGS. 3 and 4, assembly 20 is shown to include five (5) spaced binder tings 22–30. While five such rings are shown in the drawings, it will be understood that assembly 20 could include more or fewer tings. Also as shown in the drawings, the rings are equidistantly spaced along the length of center plate 18. Each binder ring is a single piece construction having a central arch shaped section 22*a*, for example. This is a generally semi-circular arch whose diameter generally corresponds to the width of the center plate. Each binder ring further has legs 22*b*, 22*c*, extending from the sides of the arch. The legs are substantially equal in length and the length of the legs determine the storage capacity of the binder. An end of leg 24*c* is secured to a locking portion of the binder assembly as described hereinafter. As shown in FIGS. 6A–6D, four different size binder rings 22-1-22-4, respectively, are shown, these tings becoming progressively shorter. Each binder ring, regardless of length has an enlarged diameter segment 32 adjacent one end 34 of the ring. The other end 36 of each ring is rounded. The surface of the binder rings are smooth to prevent tearing of paper stored in the binder.

Binder assembly 20 next includes a backplate 42 which is secured to the inside face of plate 18 by, for example, rivets 44. The backplate is comprised of a rectangular metal plate whose height and width dimensions generally correspond to those of plate 18. Extending lengthwise along one side of the backplate is a ring channel 46, and along the opposite side a backplate channel 48. Channel 48 is permanently attached to backplate 42 while ring channel 46 is detachable therefrom as described hereinafter. Each channel 46, 48 comprises a flat upper section 50, 52 respectively in which are formed spaced openings 54, 56 respectively. The diameter of the openings 54, 56 correspond to the diameter the legs of the tings. However, the diameter of openings 54 are smaller than the enlarged diameter segment 32 on the one leg of each ring. This allows these legs of the rings to be inserted into the openings up to the location of the segment 32. After the insertion, the base of the leg is flattened (as indicated at 34) so the leg can no longer be extracted from the opening. Thus one side of each ring is captured in ring channel 46. Each channel further includes outwardly flaring sidewalls (58*a*, 58*b* for channel 46, and 60*a*, 60*b* for channel 48). These openings are formed at the locations where the rings are located. In addition, channel 48 includes spaced openings 62. Rivets 64, or other comparable means of securing the backplate channel to the backplate, extend through these openings to attach channel 48 to backplate 42. Alternatively, channel 48 could be welded or glued to the backplate.

Figure 5:
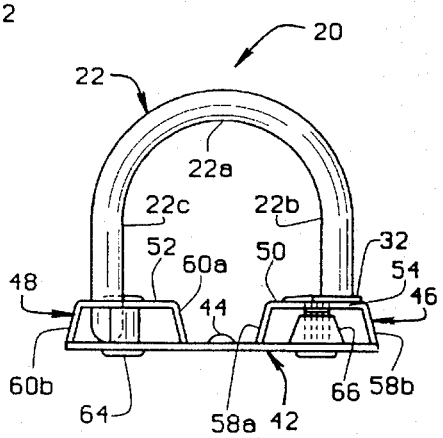
FIG. 5 is an end elevational view of the assembly.

Next, a pair of truncated cone shaped bushings 66 are formed on backplate 42. These bushings are formed along one side of the backplate directly beneath the longitudinal centerline of ring channel 46. A pair of spaced openings 68 are formed in top plate 50 of the ring channel. These openings are directly above the cone bushings. Each bushing has a threaded central bore for threadable insertion of a locking means 70 through the openings 68. In FIGS. 3–5, means 70 is shown to be a slotted head screw. However, the locking means could also include a phillips head screw, a tork screw, bolt, or other suitable threaded element by which the ring channel is removably attached to the backplate. Referring to FIG. 5, it will be noted that when the ring channel is in place, the rounded end 36 of a ring abuts the upper or outer face of backplate 42.

In use, ring binder assembly 20 provides a solid lock for securing sheets of paper in the ring binder. The free end 34 of each ring extends far enough beneath top plate 50 of backplate channel 46 that it cannot be dislodged when the ring channel is screwed into place. Thus, it is impossible to extract sheets of paper tinless they are tom out. However, the ring binder assembly is readily unlocked simply by removing the screws 72 and then lifting the ring channel away from the backplate. When so lifted, the other side of each ring is readily drawn out of the backplate channel. After removal, additional sheets can be set in place. Once this is done, then the ring channel is lowered into place with the free end of the rings again being inserted through their openings in the backplate channel. When the screws 72 are reinstalled, the assembly is securely locked. And, it will be understood if a different binder capacity is needed, this change can be accomplished by substituting one ring/ring channel sub-assembly for another while the binder is open.

What has been described is a binder for use in storing punched sheets of paper or similar punched materials. The binder includes ring binder assembly having a locking mechanism which positively and securely retains all of the material in the binder. Once locked in place, the binder assembly will not inadvertently come apart and allow paper to spill out of the binder. This is because the locking mechanism is a positive locking mechanism which, nonetheless, is easy to use to open and close the ring binder assembly. The locking mechanism is usable with a wide variety of binders and provides full page readability of papers stored in a binder, and permits individual pages to be readily copied without having to be removed from the binder. The storage capacity of a binder can be increased by replacing an assembly with one binder ring with an assembly having a longer binder ting. The binder tings are single piece, arched rings captured in a locking mechanism of the assembly. The ring binder assembly is readily unlocked so more material can be placed in the binder. The ring binder assembly is relatively low cost, and easy to fabricate and install in a binder.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A binder for use in storing sheets of paper having punched holes in them comprising:

first and second end leafs respectively forming outer covers of the binder;

a center plate positioned intermediate said respective end leafs for one side of each of said end leafs to flexibly attache to a side of said center plate for sheets of paper and other hole punched material to be stored in said binder between said end leafs;

ring means for holding sheets of paper and movable from a first and closed position to a second and open position in which sheets of paper are inserted into or removed from said binder by moving the holes punched in the paper relative to an end of said ring means exposed when said ring means is in its open position;

first channel means to which one end of said ring means is attached, said first channel means being movable relative to said center plate to move said ring means to the open position;

second channel means in which said exposed end of said ring means is covered when said ring means is in the closed position, said first channel means also being movable relative to said second channel means; and, locking means for locking said ring means in the closed position, said exposed end of said ring means being secured in a locked position by said locking means when said ring means is in its closed position thereby to secure the paper in the binder.

2. The binder of claim 1 further including a backplate attached to said centerplate, said backplate comprising an elongate metal plate whose height and width generally correspond to that of said center plate.

3. The binder of claim 2 wherein said ring means includes a plurality of binder rings equidistantly spaced along the length of said backplate.

4. The binder of claim 3 wherein each binder ring has a central arch shaped section with equal length legs extending from the respective sides of the arch, the length of the legs determining the storage capacity of the binder.

5. The binder of claim 4 wherein said ring means includes sets of rings with the rings comprising one set thereof having legs of one length and the rings of a second set thereof having legs which are of a different length whereby the storage capacity of said binder can be varied in accordance with the set of rings used.

6. The binder of claim 3 wherein said second channel means is attached to said backplate.

7. The binder of claim 6 wherein said second channel means includes a series of spaced openings through which the exposed ends of said rings extend which said rings means is in its closed position.

8. The binder of claim 7 wherein said first channel means includes a series of spaced openings therein in which the other end of said rings are captured to secure said rings to said first channel means.

9. The binder of claim 8 wherein said first channel means further includes a second set of openings formed therein, and said locking means includes screw means fitting through said second set of openings to attach said first channel means to said backplate.

10. The binder of claim 9 wherein said locking means further includes a bushing means formed on said backplate beneath said second set of openings in said first channel means.

11. The binder of claim 10 wherein said bushing means comprises a plurality of cone bushings each of which has a threaded bore and said screw means comprises a plurality of screws each of fits through one of said second openings into a cone bushing to secure said first said channel to said backplate and lock the rings in their closed position.

12. A ring binder assembly for storing sheets of paper having punched holes in them in a binder, the binder including covers with one side of each cover being flexibly attached to one sides of a center section of the binder for sheets of paper stored in the binder to be enclosed between the covers, the assembly comprising:

ring means for holding sheets of paper and movable from a first and closed position to a second and open position in which sheets of paper are inserted into or removed from said binder by moving the holes punched in the paper relative to an end of said ring means exposed when said ring means is in its open position;

first channel means to which one end of said ring means is attached, said first channel means being movable relative to said center plate to move said ring means to the open position;

second channel means in which said exposed end of said ring means is covered when said ring means is in the closed position, said first channel means also being movable relative to said second channel means; and, locking means for locking said ring means in the closed position, said exposed end of said ring means being secured in a locked position by said locking means when said ring means is in its closed position thereby to secure the paper in the binder.

13. The assembly of claim 12 further including a backplate attached to said center section, said backplate comprising an elongate metal plate whose height and width generally correspond to that of said center section.

14. The assembly of claim 13 wherein said ring means includes a plurality of binder rings equidistantly spaced along the height of the backplate with each ring having an arch shaped center section with legs of equal length extending from the respective sides of the arch, the storage capacity of the binder being a function of the length of the legs.

15. The assembly of claim 14 wherein second channel means is attached to said backplate and includes a series of spaced openings through which the exposed ends of said rings extend which said rings means is in its closed position.

16. The assembly of claim 15 wherein said first channel means includes a series of spaced openings therein in which the other end of said rings are captured to secure said rings to said first channel means.

17. The assembly of claim 16 wherein said first channel means further includes a second set of openings formed therein, and said locking means includes screw means fitting through said second set of openings to attach said first channel means to said backplate.

18. The assembly of claim 17 wherein said locking means further includes a bushing means formed on said backplate beneath said second set of openings in said first channel means, said bushing means comprising a plurality of cone bushings each of which has a threaded bore and said screw means comprises a plurality of screws each of fits through one of said second openings into a cone bushing to secure said first said channel to said backplate and lock the rings in their closed position.

19. The assembly of claim 12 wherein said ring means includes sets of rings with the rings comprising one set thereof having legs of one length and the rings of a second set thereof having legs which are of a different length whereby the storage capacity of said binder can be varied in accordance with the set of rings used.

20. In a ring binder for storing sheets of paper having punched holes therein, the binder having respective first and second end covers and a center section intermediate the covers with one side of each cover flexibly attached to opposite sides of the center section for sheets of paper stored in the binder to be enclosed between the covers, the improvement comprising a locking mechanism for holding and storing the sheets of paper comprising:

a backplate attached to said center section, the height and width of said backplate corresponding to that of said center section;

a plurality of binder rings on which said sheets of paper are captured, said binder rings being movable from a closed position to an open position with sheets of paper being inserted into the binder by inserting the holes punched in the sheets of paper over ends of said respective binder rings which are exposed when said binder rings are open, each binder ring having an arch shaped center section with legs of equal length extending from the respective sides of the arch, the storage capacity of the binder being a function of the length of the legs;

a ring channel means to which one end of each of said rings is attached, said ring channel being movable relative to said backplate to move said rings to their open position;

a backplate channel in which said exposed end of said rings is covered when said rings are in their closed position, said ring channel means being movable relative to said backplate channel; and, locking means for attaching said ring channel to said backplate, said locking means including a plurality of screws for attaching said ring channel to said backplate, removal of said screws allowing said ring channel to be lifted away from said backplate to said move the rings to their open position.

* * * * *